US008499498B2

(12) United States Patent
Heppner

(10) Patent No.: US 8,499,498 B2
(45) Date of Patent: Aug. 6, 2013

(54) SELF-DRAINING THRESHOLD ASSEMBLIES INCLUDING A RESERVOIR CHAMBER

(75) Inventor: Thomas J. Heppner, Warroad, MN (US)

(73) Assignee: Marvin Lumber and Cedar Company, Warroad, MN (US)

( * ) Notice: Subject to any disclaimer, the term of this patent is extended or adjusted under 35 U.S.C. 154(b) by 0 days.

(21) Appl. No.: 13/418,102

(22) Filed: Mar. 12, 2012

(65) Prior Publication Data

US 2012/0174490 A1 Jul. 12, 2012

Related U.S. Application Data

(63) Continuation of application No. 11/558,364, filed on Nov. 9, 2006, now Pat. No. 8,132,370.

(51) Int. Cl.
*E06B 1/70* (2006.01)

(52) U.S. Cl.
USPC ..... 49/471; 49/467

(58) Field of Classification Search
USPC ..... 49/467, 469, 471, 504; 52/209, 52/211, 302.1, 302.3
See application file for complete search history.

(56) References Cited

U.S. PATENT DOCUMENTS

| | | | |
|---|---|---|---|
| 932,190 | A | 8/1909 | Thorne |
| 1,429,203 | A | 9/1922 | Hartstra |
| 3,079,653 | A | 3/1963 | Cornell |
| 3,314,201 | A | 4/1967 | Riegelman |
| 3,851,420 | A | 12/1974 | Tibbetts |
| 3,919,815 | A | 11/1975 | Alabaster |
| 4,055,917 | A | 11/1977 | Coller |
| 4,154,033 | A | 5/1979 | Krueger et al. |
| 4,310,991 | A | 1/1982 | Seely |
| 4,513,536 | A | 4/1985 | Giguere |
| 4,686,793 | A | 8/1987 | Mills |
| 4,715,152 | A | 12/1987 | Tanikawa |
| 4,831,779 | A | 5/1989 | Kehrli et al. |
| 5,018,307 | A | 5/1991 | Burrous et al. |

(Continued)

OTHER PUBLICATIONS

"U.S. Appl. No. 11/558,364, Decision on Pre-Appeal Brief Request Aug. 16, 2011", 2 pgs.

(Continued)

*Primary Examiner* — Katherine Mitchell
*Assistant Examiner* — Catherine A Kelly
(74) *Attorney, Agent, or Firm* — Schwegman Lundberg & Woessner, P.A.

(57) ABSTRACT

Low-profile, self-draining panel threshold assemblies are discussed. The threshold assemblies comprise an interior sill portion, an exterior sill portion, and a drop-down chamber therebetween. The interior sill portion may include a condensation channel, which in one example, includes a roller track centrally positioned therein. The exterior sill portion includes a drain chamber and a reservoir chamber, where the reservoir chamber is positioned below and optionally to the exterior of the drain chamber. The drop-down chamber is partially defined by an elongate exposed weather-strip and an elongate covered weather-strip. In varying examples, a reservoir chamber height is equal to or greater than a water head height at a preselected wind load pressure. In certain examples, an effective threshold assembly height is less than or equal to ¾-inch, such as less than or equal to ½-inch. Methods and apparatuses related to the threshold assemblies are also discussed.

20 Claims, 7 Drawing Sheets

U.S. PATENT DOCUMENTS

| | | | | |
|---|---|---|---|---|
| 5,067,279 | A | 11/1991 | Hagemeyer | |
| 5,123,212 | A | 6/1992 | Dallaire et al. | |
| 5,136,814 | A | 8/1992 | Headrick | |
| 5,179,804 | A | 1/1993 | Young | |
| 5,373,671 | A | 12/1994 | Roth et al. | |
| 5,687,508 | A | 11/1997 | Fitzhenry, Jr. et al. | |
| 5,706,607 | A * | 1/1998 | Frey | 49/478.1 |
| 5,887,387 | A | 3/1999 | Dallaire | |
| 5,890,331 | A | 4/1999 | Hope | |
| 5,921,038 | A * | 7/1999 | Burroughs et al. | 52/209 |
| 5,956,909 | A | 9/1999 | Chou | |
| 6,044,600 | A | 4/2000 | McCollough | |
| 6,076,310 | A | 6/2000 | Kim | |
| 6,098,343 | A | 8/2000 | Brown et al. | |
| 6,276,099 | B1 | 8/2001 | O'Shea | |
| 6,334,283 | B1 | 1/2002 | Edger | |
| 6,665,989 | B2 * | 12/2003 | Bennett | 52/287.1 |
| 6,763,639 | B2 | 7/2004 | Bennett et al. | |
| 6,789,359 | B2 | 9/2004 | Bauman et al. | |
| 6,848,225 | B2 | 2/2005 | Lapierre | |
| 6,883,279 | B2 | 4/2005 | Fukuro et al. | |
| 8,132,370 | B2 | 3/2012 | Heppner | |
| 2002/0194788 | A1 | 12/2002 | Bennett | |
| 2003/0005644 | A1 | 1/2003 | Reithmeyer et al. | |
| 2003/0106269 | A1 | 6/2003 | Bauman et al. | |
| 2004/0231260 | A1 | 11/2004 | Burkart | |
| 2005/0055912 | A1 | 3/2005 | Teodorovich | |
| 2006/0080902 | A1 | 4/2006 | Bren | |
| 2006/0150521 | A1 | 7/2006 | Henry et al. | |
| 2008/0110100 | A1 | 5/2008 | Heppner | |

OTHER PUBLICATIONS

"U.S. Appl. No. 11/558,364, Examiner Interview Summary mailed Jan. 28, 2011", 4 pgs.
"U.S. Appl. No. 11/558,364, Examiner Interview Summary mailed Sep. 2, 2010", 3 pgs.
"U.S. Appl. No. 11/558,364, Final Office Action mailed Apr. 7, 2011", 15 pgs.
"U.S. Appl. No. 11/558,364, Final Office Action mailed May 28, 2010", 12 pgs.
"U.S. Appl. No. 11/558,364, Non-Final Office Action mailed Oct. 8, 2010", 13 pgs.
"U.S. Appl. No. 11/558,364, Non-Final Office Action mailed Nov. 13, 2009", 15 pgs.
"U.S. Appl. No. 11/558,364, Notice of Allowance mailed Nov. 9, 2011", 7 pgs.
"U.S. Appl. No. 11/558,364, Pre-Appeal Brief Request mailed Jul. 7, 2011", 5 pgs.
"U.S. Appl. No. 11/558,364, Response filed Jan. 10, 2011 to Non Final Office Action mailed Oct. 8, 2010", 11 pgs.
"U.S. Appl. No. 11/558,364, Response filed Feb. 15, 2010 to Non Final Office Action mailed Nov. 13, 2009", 11 pgs.
"U.S. Appl. No. 11/558,364, Response filed Mar. 3, 2009 to Restriction Requirement mailed Feb. 5, 2009", 10 pgs.
"U.S. Appl. No. 11/558,364, Response filed Aug. 30, 2010 to Final Office Action mailed May 28, 2010", 11 pgs.
"U.S. Appl. No. 11/558,364, Restriction Requirement mailed Feb. 5, 2009", 9 pgs.

* cited by examiner

SELF-DRAINING THRESHOLD ASSEMBLIES INCLUDING A RESERVOIR CHAMBER

RELATED APPLICATION

This application is a continuation of and claims the benefit of priority under 35 U.S.C. §120 to U.S. patent application Ser. No. 11/558,364, entitled "LOW-PROFILE, SELF-DRAINING THRESHOLD ASSEMBLIES," filed on Nov. 9, 2006, which is hereby incorporated by reference herein in its entirety.

TECHNICAL FIELD

This patent document pertains generally to thresholds, such as for use with door or window assemblies. More particularly, but not by way of limitation, this patent document pertains to low-profile, self-draining threshold assemblies.

BACKGROUND

Threshold assemblies are typically associated with door and window assemblies, and provide a transition from an exterior or outside environment to an interior space of a building. Such threshold assemblies are anchored to or comprise the lower, horizontal jamb of a door or window frame, and are intended to provide sealing and a weather-proofing barrier for the door or window assembly. For instance, threshold assemblies should provide adequate run-off for rain or condensation so that there is no accumulation of water in or around the door or window frame that may cause mildew, rot or other water damage. Over an extended period of time, even small amounts of water can eventually lead to water damage or fungal growth in the surrounding building walls.

Weather-stripping alone may not be completely effective to prevent water accumulation in or around the door or window frame or subsequent water leakage into the interior of the building in normal situations; and particularly in those situations where the door or window assembly is subjected to high driving winds and pressure differentials on opposite sides of the door or window. High winds and pressure differentials have a tendency to drive water or air into and past weather-stripping. For instance, it has been found that weather-stripping solely at the front of a door or window assembly fails to provide an effective barrier to entry of water and air into the associated threshold assembly and thus, water and air may leak past such a weather-stripping configuration under various conditions.

Building standards in many countries of the world are becoming more stringent in prohibiting the intrusion of wind blow rain water or condensation, for example, into the interior of buildings through door or window assemblies. To this end, various types of drainage systems have been designed and incorporated into threshold assemblies in attempt to channel water away from the thresholds and thus, reduce or eliminate the accumulation of water in the thresholds or subsequent water leakage into the interior of buildings. Despite these efforts, window and door drainage systems persist as being a common source for the infiltration of wind-blown or pressure differential driven water through door and window assemblies.

Recently, the American with Disabilities Act (ADA) has promulgated a set guidelines for buildings and facilities. The guidelines provide, among other things, specified dimensions or dimension ranges to which building structures should follow for proper handicap accessibility. As one example, the guidelines state that threshold assemblies, provided at a doorway, should not exceed ¾-inch in height for exterior sliding doors or ½-inch for other types of doors. The guidelines go on to recite that changes in level up to ¼-inch can be vertical and do not need an edge treatment; however, changes in level between ¼-inch and ½-inch should have a beveled slope equaling 1:2, and changes in level greater than ½-inch should be equipped with a ramp. Many existing door drainage systems, which attempt to channel water away from the threshold assemblies, fail to meet the ADA threshold size guidelines, thereby minimizing their utility and desirability.

What is needed is a window or door assembly drainage system that permits the ready evacuation of rain water or condensation, while preventing heavy winds or pressure differentials from forcing rain or condensation into a door or window threshold assembly and subsequently into an interior of a building. What is further needed is threshold which may be designed to meet both the ADA guidelines and any applicable building water intrusion standards.

SUMMARY

Low-profile, self-draining panel threshold assemblies are discussed. The threshold assemblies comprise an interior sill portion, an exterior sill portion, and a drop-down chamber therebetween. The interior sill portion may include a condensation channel, which in one example, includes a roller track centrally positioned therein. The exterior sill portion includes a drain chamber and a reservoir chamber, where the reservoir chamber is positioned below and optionally to the exterior of the drain chamber. The drop-down chamber is partially defined by an elongate exposed weather-strip and an elongate covered weather-strip. In varying examples, a reservoir chamber height is equal to or greater than a water head height at a preselected wind load pressure. In certain examples, an effective threshold assembly height is less than or equal to ¾-inch, such as less than or equal to ½-inch. Methods and apparatuses related to the threshold assemblies are also discussed.

In Example 1, a threshold assembly comprises an interior sill portion including a condensation channel; an exterior sill portion including a drain chamber and a reservoir chamber, the reservoir chamber positioned at least partially below the drain chamber; and a drop-down chamber between the interior sill portion and the exterior sill portion.

In Example 2, the threshold assembly of Example 1 is optionally configured such that a reservoir chamber height is equal to or greater than a water head height at a preselected wind load pressure.

In Example 3, the threshold assembly of Examples 1-2 is optionally configured such that an effective threshold assembly height is less than or equal to ¾-inch.

In Example 4, the threshold assembly of Examples 1-3 is optionally configured such that the interior sill portion, the exterior sill portion, and the drop-down chamber are supported by a mutual base plate.

In Example 5, the threshold assembly of Examples 1-4 is optionally configured such that a bottom portion of the reservoir chamber comprises one or more drain apertures.

In Example 6, the threshold assembly of Examples 1-5 optionally comprises an elongate exposed weather-strip and an elongate covered weather-strip, the weather-strips partially defining the drop-down chamber.

In Example 7, the threshold assembly of Examples 1-6 optionally comprises one or more insert seals disposed in one or both of the drain chamber or the reservoir chamber.

In Example 8, the threshold assembly of Example 7 is optionally configured such that at least one of the insert seals comprises a blocking seal disposed to separate the drain chamber into a water and air inlet chamber and an air outlet chamber.

In Example 9, the threshold assembly of Examples 1-8 optionally comprises one or more air tubes fluidly coupling the drain chamber and the condensation channel.

In Example 10, the threshold assembly of Examples 1-9 optionally comprises one or more gutter channels disposed between the drop-down chamber and the drain chamber and between the drain chamber and the reservoir chamber.

In Example 11, the threshold assembly of Examples 1-10 optionally comprises one or more drain tubes coupled to a bottom portion of the reservoir chamber.

In Example 12, a window or door assembly comprises a frame including a pair of vertically extending side jambs and a horizontally extending head jamb; an operator panel movable between an open position and a closed position, the frame surrounding the peripheral edges of the operator panel in the closed position; and a threshold assembly spaced from the head jamb, the threshold assembly including, an interior sill portion, and an exterior sill portion including a drain chamber and a reservoir chamber, the reservoir chamber positioned at least partially below and to the exterior of the drain chamber.

In Example 13, the window or door assembly of Example 12 is optionally configured such that the threshold assembly includes an elongate exposed weather-strip and an elongate covered weather-strip; the exposed weather-strip disposed to contact a face of the operator panel when in the closed position; and the covered weather-strip disposed to contact an underside of the operator panel when in the closed position.

In Example 14, the window or door assembly of Examples 12-13 is optionally configured such that a reservoir chamber height is equal to or greater than a water head height at a preselected wind load pressure.

In Example 15, the window or door assembly of Examples 12-14 is optionally configured such that the operator panel comprises one or more of a sliding door, an in-swinging door, or an out-swinging door.

In Example 16, the window or door assembly of Examples 12-15 is optionally configured such that a top surface of the reservoir chamber is positioned substantially level with an adjacent surface.

In Example 17, the window or door assembly of Examples 12-16 is optionally configured such that an effective threshold assembly height is less than or equal to ¾-inch.

In Example 18, a method comprises draining a flow of one or both of water or air into and through a drain chamber to a reservoir chamber, including draining the flow of water to a portion of the reservoir chamber at a position lower than the drain chamber; dispersing the air into a building interior; and removing the water from the reservoir chamber.

In Example 19, the method of Example 18 optionally comprises preventing the flow of one or both of water or air into and through the drain chamber, including selecting a reservoir chamber height equal to or greater than a water head height at a preselected wind load pressure.

In Example 20, the method of Examples 18-19 is optionally configured such that draining the flow of water or air includes using an exposed weather-strip and a covered weather-strip to direct the flow through the drain chamber.

In Example 21, the method of Examples 18-20 is optionally configured such that draining the flow of water or air includes using a base plate sloping downward from the drain chamber to the reservoir chamber.

In Example 22, the method of Examples 18-21 is optionally configured such that removing the water from the reservoir chamber includes releasing the water through one or more drain apertures when a threshold pressure is equal to or greater than an exterior pressure.

In Example 23, the method of Examples 18-22 is optionally configured such that removing the water from the reservoir chamber includes using one or more drain tubes coupled to a portion of the reservoir chamber.

Advantageously, the present threshold assemblies permit the ready evacuation of rain water or condensation, while preventing heavy winds from forcing rain or condensation into such assemblies and subsequently into an interior of a building. In addition to properly dispersing and sealing against water intrusion, the present threshold assemblies may be designed to meet both the ADA threshold size guidelines and any applicable building water intrusion standards. These and other examples, advantages, and features of the present threshold assemblies will be set forth in part in the detailed description, which follows, and in part will become apparent to those skilled in the art by reference to the following description of the present threshold assemblies and drawings or by practice of the same.

BRIEF DESCRIPTION OF THE DRAWINGS

In the drawings, like numerals describe substantially similar components throughout the several views. Like numerals having different letter suffixes represent different instances of substantially similar components. The drawings illustrate generally, by way of example, but not by way of limitation, various embodiments discussed in the present document.

DETAILED DESCRIPTION

The following detailed description includes references to the accompanying drawings, which form a part of the detailed description. The drawings show, by way of illustration, specific embodiments in which the present threshold assemblies, apparatuses, and methods may be practiced. These embodiments, which are also referred to herein as "examples," are described in enough detail to enable those skilled in the art to practice the present threshold assemblies, apparatuses, and methods. The embodiments may be combined, other embodiments may be utilized or structural or logical changes may be made without departing from the scope of the present threshold assemblies, apparatuses, and methods. The following detailed description is, therefore, not to be taken in a limiting sense, and the scope of the present threshold assemblies, apparatuses, and methods are defined by the appended claims and their legal equivalents.

In this document, the terms "a" or "an" are used to include one or more than one; and the term "or" is used to refer to a nonexclusive "or" unless otherwise indicated. In addition, it is to be understood that the phraseology or terminology employed herein, and not otherwise defined, is for the purpose of description only and not of limitation.

Door and window threshold assemblies are provided herein for permitting the ready evacuation of rain water or condensation, while preventing heavy winds from forcing rain or condensation into such assemblies and subsequently into an interior of a building. In addition to properly dispersing and sealing against water intrusion, the present threshold assemblies may be designed to meet both the ADA size guidelines and any applicable building water intrusion standards. In varying examples, the threshold assemblies comprise an interior sill portion, an exterior sill portion, and a drop-down chamber therebetween.

Figure 1:
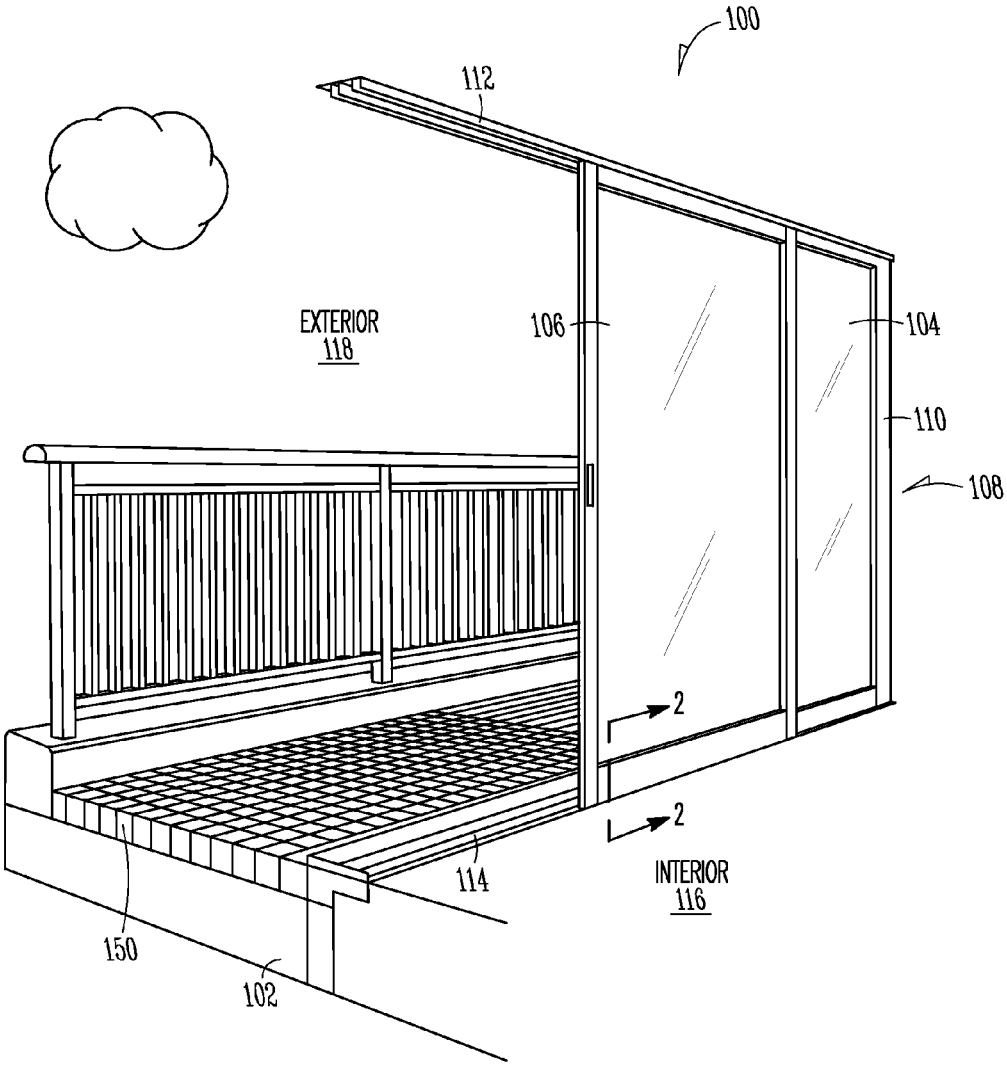
FIG. 1 is an isometric view of a sliding door assembly, including an operator sash panel, a stationary sash panel, a door frame, and a threshold assembly, as constructed in accordance with at least one embodiment.

FIG. 1 illustrates a sliding door assembly 100 disposed between an exterior 118 and an interior 116 of a building 102. The sliding door assembly 100 includes a stationary sash panel 104 and an operator sash panel 106 mounted within a door frame 108, which includes two vertically extending side jambs 110, and a horizontally extending head jamb 112. The sliding door assembly 100 further includes a threshold assembly 114, which provides sealing and weather-proofing for the bottom of the stationary 104 and operator 106 sash panels. As shown, portions of the threshold assembly 114 may be disposed level (or substantially level) with an adjacent surface, such as a deck 150. It should be noted that although the threshold assembly 114 is illustrated as being utilized in connection with a sliding door assembly 100, a similar threshold assembly 114 could also be utilized with a window assembly. Thus, the threshold assembly description herein is not to be limited to door assembly use only.

Figure 2:
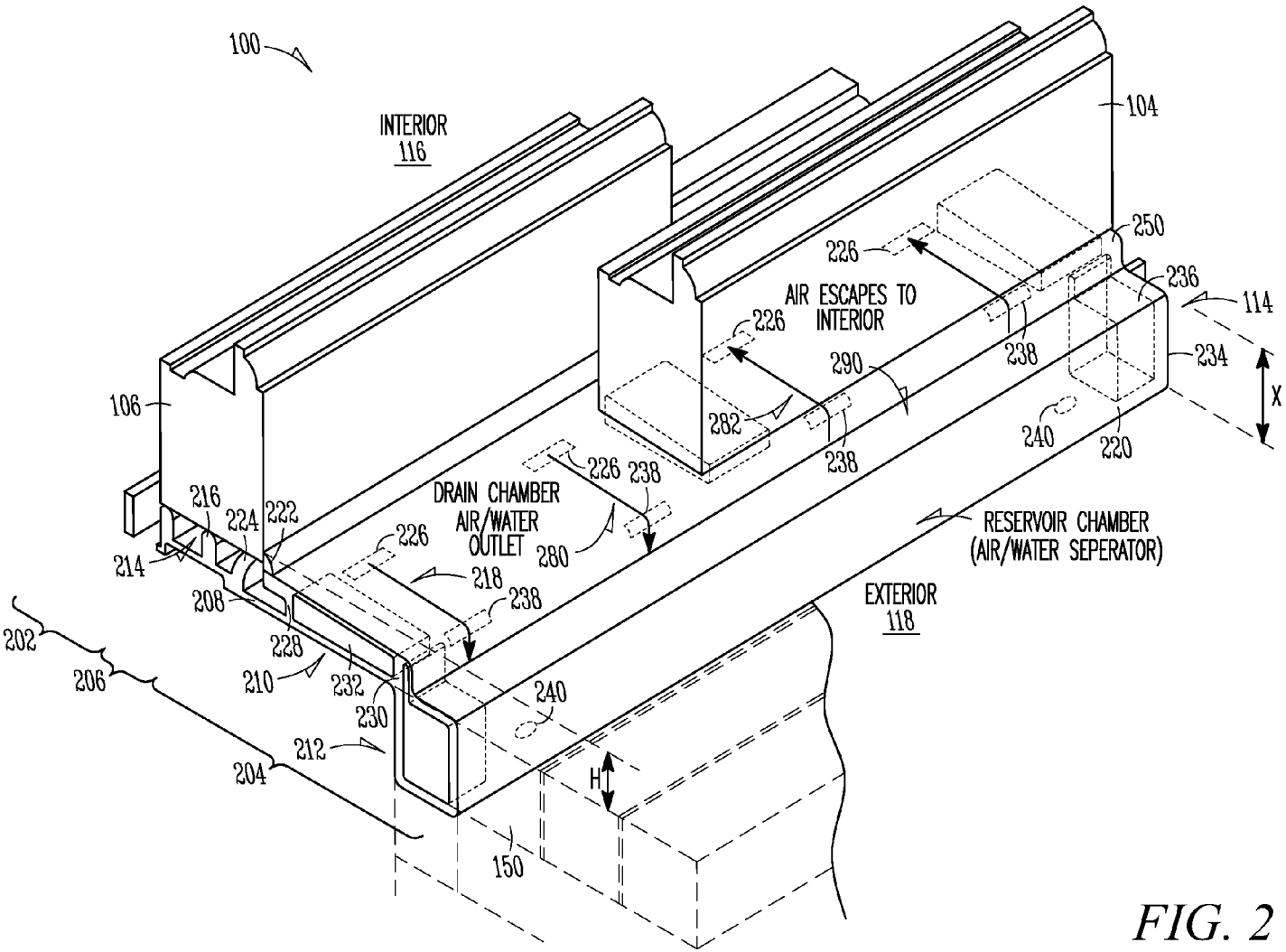
FIG. 2 is an isometric sectional view of portions of a sliding door assembly, such as taken along line 2-2 of FIG. 1.

FIG. 2 illustrates portions of a sliding door assembly 100 in cross-section. More specifically, FIG. 2 illustrates isometric cross-sections of a stationary sash panel 104, an operator sash panel 106, and a threshold assembly 114. As shown, the threshold assembly 114 extends under a bottom portion of the stationary 104 and operator 106 sashes and includes an interior sill portion 202, an exterior sill portion 204, and a drop-down chamber 206 therebetween. In this example, but as may vary, the interior sill portion 202, the exterior sill portion 204, and the drop-down chamber 206 are supported by a mutual base plate 208 having a substantially straight cross-section portion 210 and an L-shaped cross-section portion 212. In some examples, the base plate 208 may slant downwardly along a portion thereof, such as from the interior sill portion 202 or the drop-down chamber 206 to the exterior sill portion 204, thereby urging any drop-water water or air toward an exterior 118 of a building 102 (FIG. 1).

As shown, the interior sill portion 202 is disposable adjacent an interior 116 of the building 102 (FIG. 1), and may include a longitudinally extending condensation channel 214 having a roller track 216 centrally positioned therein. The operator sash panel 106 is positioned and configured to ride over the roller track 216 during its sliding movement between open and closed positions via an integrated bearing assembly, for example.

Opposite the interior sill portion 202, the exterior sill portion 204 is disposable adjacent the exterior 118 of the building 102 (FIG. 1). In this example, the exterior sill portion 204 includes a drain chamber 218 and a reservoir chamber 220. The drain chamber 218 is positioned below and to the exterior of the operator sash panel 106 and extends between the two vertically extending side jambs 110 (FIG. 1) or a portion thereof. The reservoir chamber 220 is positioned below and to the exterior of the drain chamber 218 and also extends between the two vertically extending side jambs 110 (FIG. 1) or a portion thereof.

Between the interior sill portion 202 and the exterior sill portion 204 lies the drop-down chamber 206. The drop-down chamber 206 is positioned at least partially in a weather-strip plane (i.e., a plane defined by one or more weather-stripping members) for catching any water (such as wind-blown rain water) that leaks past a longitudinally extending exposed weather-strip 222 contacting an exterior face of the operator sash panel 106. This drop-down chamber 206 is partially defined by the exposed weather-strip 222 and a covered weather-strip 224, both of which may be disposed to come in contact with a portion of the operator sash panel 106. For instance, the exposed weather-strip 222 may be disposed adjacent the exterior face of the operator sash panel 106, such that the exposed strip 222 is flexed by the operator sash panel 106 when the sash is moved to the closed position. The covered weather-strip 224 may be disposed in a close fitting and rubbing relationship with an underside surface of the operator sash panel 106, such that the strip presses up against the underside surface of the sash substantially across its entire length when closed.

The sealing provided by the exposed weather-strip 222 aims to keep as much air and water flow as reasonably possible from entering the drop-down chamber 206, such as when the threshold pressure is less than that of the exterior 118. Despite the exposed weather-strips' 222 efforts, water and air may pass between the exposed strip 222 and the adjacent exterior face of the operator sash panel 106, thereby into the drop-down chamber 206. The covered weather-strip 224, in conjunction with the underside surface of the operator sash panel 106, prevent this drop-down water and air from penetrating toward the interior 116 of the building 102 (FIG. 1), such as into or past the condensation channel 214. Rather, the drop-down water and air is guided into and through the drain chamber 218 via one or more gutter channels 226 disposed in an inner upwardly extending wall 228 separating the drop-down chamber 206 from the drain chamber 218. The aforementioned weather-strips 222, 224 may comprise any high resiliency material, such as a foam plastic.

The drain chamber 218 is definable by the inner upwardly extending wall 228, an opposite middle upwardly extending wall 230, and one or more insert seals 232. Optionally, at least one of the one or more insert seals 232 disposed in the drain chamber 218 may acts as a blocking seal to separate the drain chamber 218 into a water and air inlet chamber 280 and an air outlet chamber 282. In one example, the drain chamber 218 comprises a hollow, substantially rectangular-shaped structure which extends longitudinally the entire length of the threshold assembly 114. Drop-down water and air entering the drain chamber 218 via the one or more gutter channels 226 may be urged toward and into the reservoir chamber 220 via a downwardly slanted base plate 208 portion and one or more gutter channels 238 disposed in the middle upwardly extending wall 230.

Figure 6:
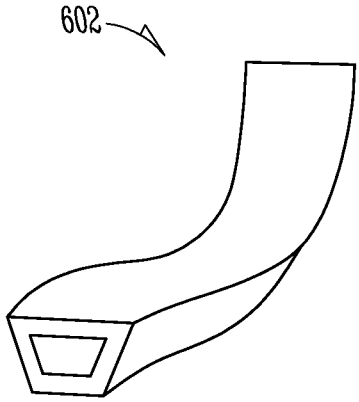
FIG. 6 is an isometric view of a drain tube, as constructed in accordance with at least one embodiment.

The reservoir chamber 220 separates the air and water flowing from the drain chamber 218. The water flows into the reservoir chamber 220 and air is allowed to disperse to the interior 116 of the attached building 102 (FIG. 1) via the one or more gutter channels 226, 238 disposed in the inner 228 and middle 230 upwardly extending walls, respectively. The reservoir chamber 220 is definable by the middle upwardly extending wall 230, an opposite outer upwardly extending wall 234, and one or more insert seals 236. In one example, the reservoir chamber 220 is a hollow, substantially rectangular-shaped structure which extends longitudinally along the entire length of the threshold assembly 114. The reservoir chamber 220 is further provided with a water removal means, such as one or more apertures 240 located at a lower portion of the chamber 220. In another example, the water removal means comprises one or more drain tubes 602 (FIG. 6). The reservoir chamber 220 holds the water when the threshold pressure is less than that of the exterior 118 (FIG. 1). As pressure fluctuates, the water in the reservoir chamber 220 is allowed to rise and fall via the water removal means.

The height of the reservoir chamber X may dictate the performance level of a threshold assembly 114. In varying examples, the height of the reservoir chamber is selected such that the threshold assembly 114 resists water and air penetration, such as during the presence of a storm when the interior pressure typically decreases. That is, the height is selected by mathematical calculations to be greater than or equal to the height of a water head at wind load pressures. For instance, the selection of the reservoir chamber height may be performed as follows:

$$P=(0.002496)\times(V^2) \quad \text{[Eq. 1]}$$

$$WH=0.192\times P \quad \text{[Eq. 2]}$$

Where: V=wind velocity in miles per hour; P=wind load in pounds per square foot; and WH=water head in inches of $H_20$. As one example, for 49 mile per hour winds, the reservoir chamber height should be selected at approximately 1.30 inches, and at least 1.15 inches.

Wind may be defined as air in motion parallel to the ground. When air is moving in a horizontal direction at a given velocity (V), it exerts a static or dynamic wind load pressure (P) on a stationary vertical plane perpendicular to the wind direction, that is proportional to the square of its velocity. Wind striking the vertical plane is the same as wind blowing against a door or window of a door or window assembly, respectively. When rain is introduced into the moving air, the static or dynamic wind load pressure (P) will hold the rain water at a calculable height or water head (WH) in the reservoir chamber 220.

Since interior 116 (FIG. 1) water leakage is objectionable and most often unacceptable to building occupants and in light of building standards, it is necessary to design threshold assemblies 114 that will resist water penetration during adverse weather conditions. To this end, the Window and Door Manufacturers Association (WDMA) has established specified design parameters (e.g., water test pressure (WTP) and structural test pressure (STP)) based on, among other things, water head (WH) to which window and door assemblies should adhere. It is a generally accepted practice that the water test pressure (WTP) is calculated as being equal to fifteen percent (15%) of the positive structural test pressure (STP) under full service loads.

The present threshold assemblies 114 comprise a reservoir chamber 220 that is positioned lower and to the exterior of other portions of the assembly. This lower placement of the reservoir chamber 220 allows a deck 150 (shown in phantom) or other adjacent surface to be disposed level (or substantially level) with a top surface 290 of the reservoir chamber 220. In this way, an effective height H (i.e., a height relative to one or more adjacent surfaces) of the present threshold assembly 114 may be minimized (thereby meeting the ADA guidelines for maximum effective threshold height), while still providing the necessary resistance to water and air intrusion (via the necessary reservoir chamber height X). Further, such lower placement of the reservoir chamber 220 may allow for increased water and air intrusion resistance (as interior 116 and exterior 118 pressures fluctuate). The one or more gutter channels 226, 238 allow the reservoir pressure to be spread throughout the drop-down chamber 206 and the drain chamber 218 thereby providing resistant to water and air intrusion via a collective threshold pressure.

Covering portions of the drain chamber 218 and the reservoir chamber 220 is a downwardly ramping top cover 250 extending from the inner upwardly extending wall 228 to the middle 230 or the outer 234 upwardly extending wall. In one example, the top cover 250 includes a non-skid surface. Among other things, the threshold assembly 114 may be manufactured from steel, aluminum, wood, plastic, fiberglass, or combinations thereof; and may be extruded, injection molded or fabricated by any suitable process that lends itself to these materials. By using theses materials and fabrication techniques in conjunction with the aforementioned threshold design, the present threshold assemblies provide the strength and rigidity needed to ensure support of weights, such as the weight of the operator 106 and stationary 104 sash panels and the weight of a person traversing over the threshold 114.

Figure 3:
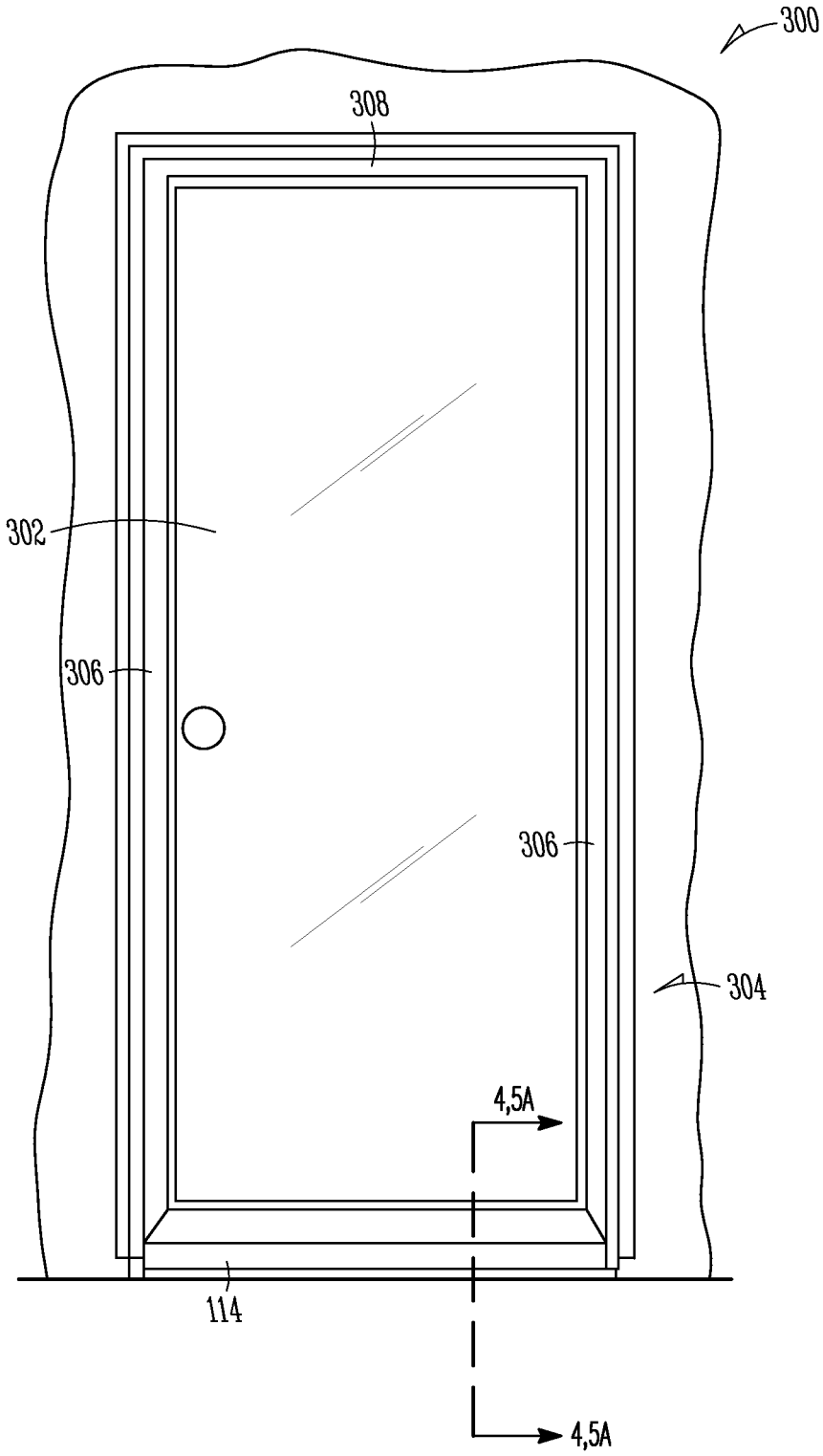
FIG. 3 is a front view of an in-swinging or out-swinging door assembly, including an operator sash panel, a door frame, and a threshold assembly, as constructed in accordance with at least one embodiment.

While the present threshold assemblies 114 have been discussed in association with sliding door assemblies 100 (FIG. 1), use of the present subject matter is not limited thereto. Rather, the present threshold assemblies 114 may be used with doors and windows (collectively "panels") of various configurations, such as in-swinging door panels and out-swinging door panels, as will now be discussed. Turning to FIG. 3, a door assembly 300 including an operator door panel 302 and a doorway 304 defined by first and second vertically extending side door jambs 306 connected by a horizontally extending head jamb 308 is illustrated. The operator door 302 is allowed to swing between an inwardly open position (see FIG. 4) or an outwardly open position (see FIG. 5) and a closed position in which it extends across the entire width of the doorway 304. The door assembly 300 further includes a threshold assembly 114, which provides sealing and weatherproofing for the bottom of the operator door 302 when in the closed position. Weather-stripping along the vertical edges of the operator door 302 prevents water from passing to the interior 116 (FIG. 1) of a building 102 (FIG. 1) and also conducts water downward to the threshold assembly 114.

Figure 4:
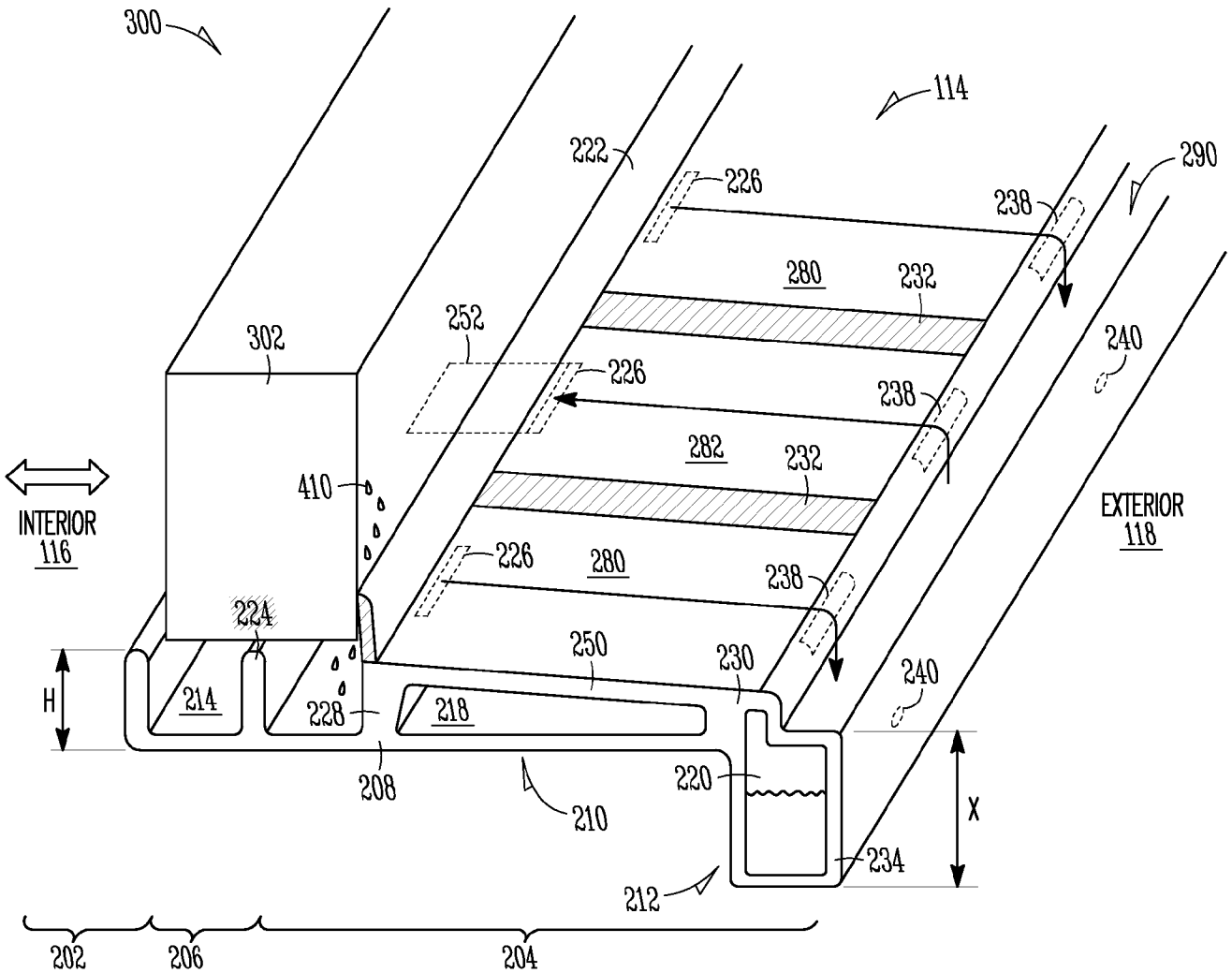
FIG. 4 is an isometric sectional view of portions of an in-swinging door assembly, such as taken along line 4-4 of FIG. 3.

FIG. 4 illustrates portions of a door assembly 300 in cross-section. More specifically, FIG. 4 illustrates isometric cross-sections of an in-swinging operator door panel 302 and a threshold assembly 114. As shown, the threshold assembly 114 extends under a bottom portion of the in-swinging operator door panel 302 and includes an interior sill portion 202, an exterior sill portion 204, and a drop-down chamber 206 therebetween. In this example, but as may vary, the interior sill portion 202, the exterior sill portion 204, and the drop-down chamber 206 are supported by a mutual base plate 208 having a substantially straight cross-section portion 210 and an L-shaped cross-section portion 212. In some examples, the base plate 208 may slant downwardly along a portion thereof, such as from the interior sill portion 202 or the drop-down chamber 206 to the exterior sill portion 204, thereby urging any drop-water water or air toward an exterior 118 of a building 102 (FIG. 1).

As shown, the interior sill portion 202 is disposable adjacent an interior 116 of the building 102 (FIG. 1), and may include a longitudinally extending condensation channel 214 configured to allow the in-swinging operator door panel 302 to move between an open and closed (shown) position.

Opposite the interior sill portion 202, the exterior sill portion 204 is disposable adjacent an exterior 118 of the building 102 (FIG. 1). In this example, the exterior sill portion 204 includes a drain chamber 218 and a reservoir chamber 220. The drain chamber 218 is positioned below and to the exterior of the in-swinging operator door panel 302 and extends between the two vertically extending side jambs 306 (FIG. 3) or a portion thereof. The reservoir chamber 220 is positioned below and to the exterior of the drain chamber 218 and also extends between the two vertically extending side jambs 306 (FIG. 3) or a portion thereof.

Between the interior sill portion 202 and the exterior sill portion 204 lies the drop-down chamber 206. The drop-down chamber 206 is positioned at least partially in a weather-strip plane for catching any water (such as wind-blown rain 410 water) that leaks past a longitudinally extending exposed weather-strip 222 contacting an exterior face of the in-swinging operator door panel 302. This drop-down chamber 206 is partially defined by the exposed weather-strip 222 and a covered weather-strip 224, both of which may be disposed to come in contact with portions of the in-swinging operator door panel 302. For instance, the exposed weather-strip 222 may be disposed adjacent the exterior face of the in-swinging operator door panel 302, such that the strip 222 is flexed by the in-swinging operator door panel 302 when the door is moved to the closed position (shown). The covered weather-strip 224 may be disposed in a close fitting and rubbing relationship with an underside surface of the in-swinging operator door panel 302, such that the strip presses up against the underside surface of the door substantially across its entire length when closed.

The sealing provided by the exposed weather-strip 222 aims to keep as much air and water flow as reasonably possible from entering the drop-down chamber 206, such as when the threshold pressure is less than that of the exterior 118. Despite the exposed weather-strips' 222 efforts, water and air may pass between the strip 222 and the adjacent exterior face of the in-swinging operator door panel 302 into the drop-down chamber 206. The covered weather-strip 224, in conjunction with the underside surface of the in-swinging operator door panel 302, prevent this drop-down water and air from penetrating toward the interior 116 of the building 102 (FIG. 1), such as into or past the condensation channel 214. Rather, the drop-down water and air is guided into and through the drain chamber 218 via one or more gutter channels 226 disposed in an inner upwardly extending wall 228 separating the drop-down chamber 206 from the drain chamber 218. The aforementioned weather-strips 222, 224 may comprise any high resiliency material, such as a foam plastic.

The drain chamber 218 is definable by the inner upwardly extending wall 228, an opposite middle upwardly extending wall 230, and one or more insert seals 232 (see also FIG. 2). At least one of the one or more insert seals 232 disposed in the drain chamber 218 may acts as a blocking seal to separate such drain chamber 218 into a water and air inlet chamber 280 and an air outlet chamber 282. In one example, the drain chamber 218 comprises a hollow, substantially rectangular-shaped structure which extends longitudinally the entire length of the threshold assembly 114. Drop-down water and air entering the drain chamber 218 via the one or more gutter channels 226 may be urged toward and into the reservoir chamber 220 via a downwardly slanted base plate 208 portion and one or more gutter channels 238 disposed in the middle upwardly extending wall 230.

The reservoir chamber 220 separates the air and water flowing from the drain chamber 218. The water flows into the reservoir chamber 220 and air is allowed to disperse to the interior of the attached building 102 (FIG. 1) via the one or more gutter channels 226, 238 disposed in the inner 228 and middle 230 upwardly extending walls, respectively, in conjunction with one or more air tubes 252 associated with at least one of the gutter channels of the air outlet chamber 282. After traveling though the one or more air tubes 252 to the interior 116 of the building, the air is allowed to disperse in the condensation channel 214. The reservoir chamber 220 is definable by the middle upwardly extending wall 230, an opposite outer upwardly extending wall 234, and one or more insert seals 236 (FIG. 2). In one example, the reservoir chamber 220 is a hollow, substantially rectangular-shaped structure which extends longitudinally along the entire length of the threshold assembly 114. The reservoir chamber 220 is further provided with a water removal means, such as one or more apertures 240 located at a lower portion of the chamber 220. In another example, the water removal means comprises one or more drain tubes 602 (FIG. 6). The reservoir chamber 220 holds the water when the threshold pressure is less than that of the exterior 118. As pressure fluctuates, the water in the reservoir chamber 220 is allowed to rise and fall via the water removal means.

As discussed above, the height of the reservoir chamber X may dictate the performance level of a threshold assembly 114. The present threshold assemblies 114 comprise a reservoir chamber 220 that is positioned lower and to the exterior of other portions of the assembly 114. This lower placement of the reservoir chamber 220 allows a deck 150 (FIGS. 1, 2) or other adjacent surface to be disposed level (or substantially level) with a top surface 290 of the reservoir chamber 220. In this way, the effective height H of the present threshold assembly 114 may be minimized (thereby meeting the ADA guidelines for maximum effective threshold height), while still providing the necessary resistance to water and air intrusion (via the necessary reservoir chamber height X). Further, such lower placement of the reservoir chamber 220 may allow for increased water and air intrusion resistance (as interior 116 and exterior 118 pressures fluctuate). The one or more gutter channels 226, 238 allow the reservoir pressure to be spread throughout the drop-down chamber 206 and the drain chamber 218 thereby providing resistant to water and air intrusion via a collective threshold pressure.

Covering portions of the drain chamber 218 and the reservoir chamber 220 is a downwardly ramping top cover 250 extending from the inner upwardly extending wall 228 to the middle 230 or the outer 234 upwardly extending wall. In one example, the top cover 250 includes a non-skid surface. Among other things, the threshold assembly 114 may be manufactured from steel, aluminum, wood, plastic, fiberglass, or combinations thereof; and may be extruded, injection molded or fabricated by any suitable process that lends itself to these materials. By using theses materials and fabrication techniques in conjunction with aforementioned threshold design, the present threshold assemblies provide the strength and rigidity needed to ensure support of weights, such as the weight of the in-swinging operator door panel 302 and the weight of a person who traverses over the threshold 114.

Figure 5A:
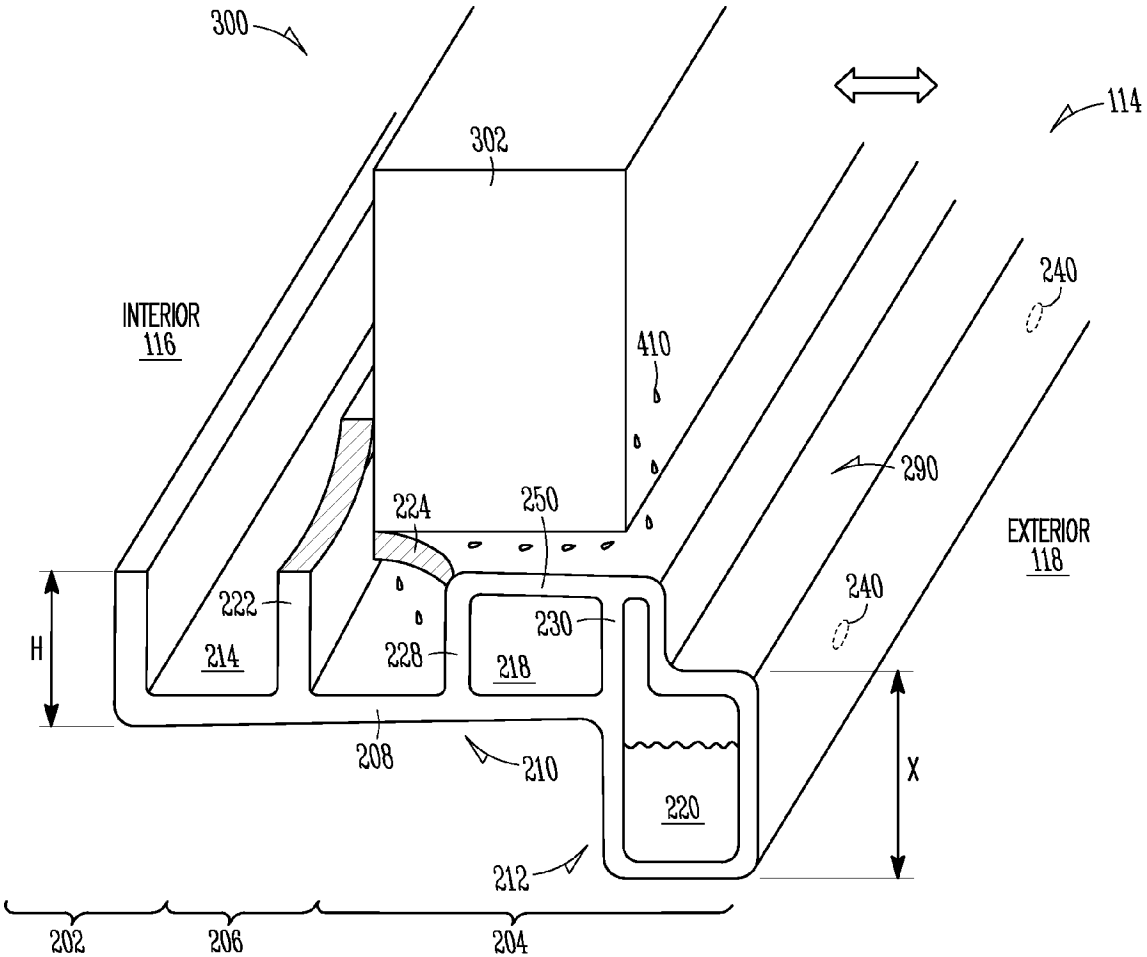
FIG. 5A is an isometric sectional view of portions of an out-swinging door assembly, such as taken along line 5A-5A of FIG. 3.
Figure 5B:
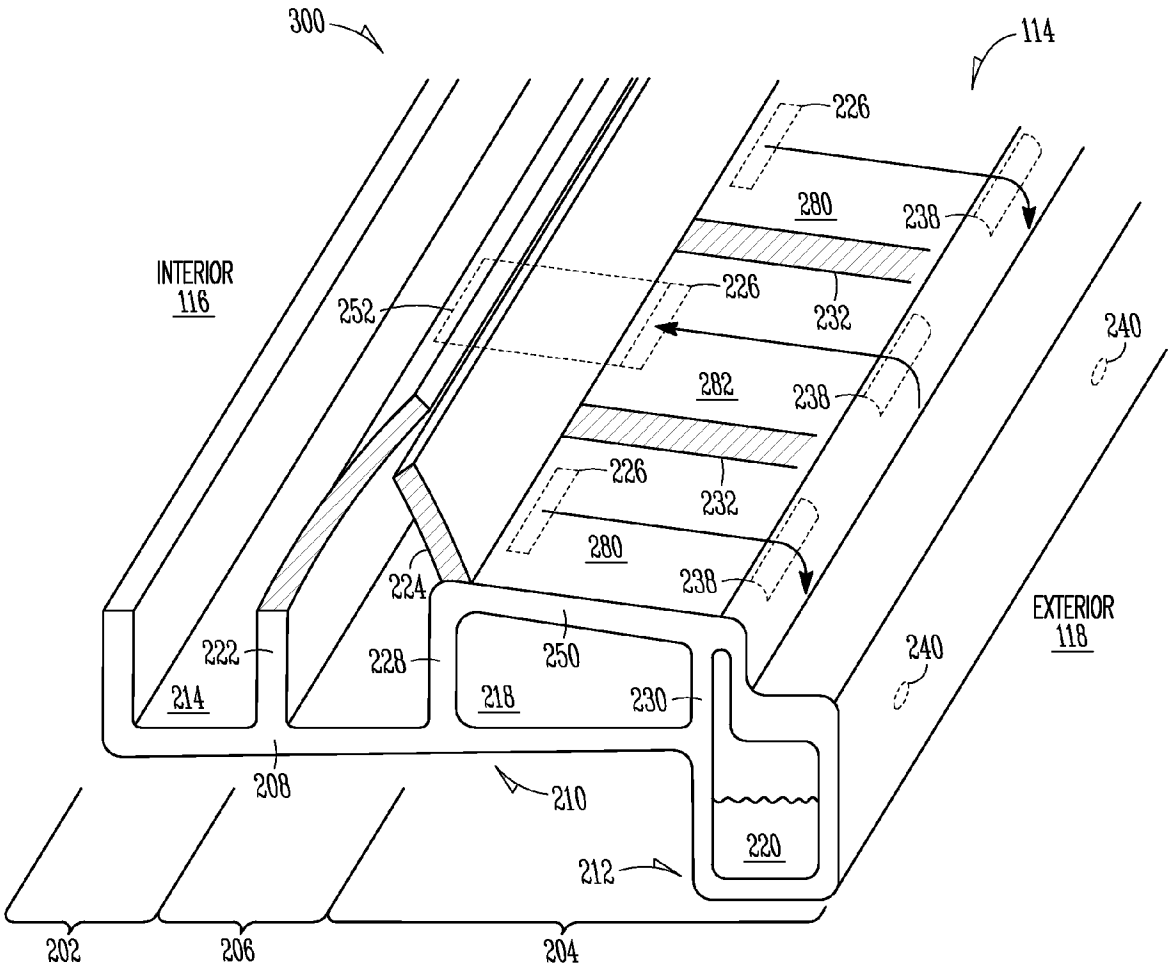
FIG. 5B is an isometric sectional view of an out-swinging door threshold assembly, as constructed in accordance with at least one embodiment.

FIGS. 5A-5B illustrate portions of a door assembly 300 in cross-section. More specifically, FIG. 5A illustrates isometric cross-sections of an out-swinging operator door panel 302 and a threshold assembly 114; while FIG. 5B illustrates isometric cross-sections of the threshold assembly 114 only. As shown, the threshold assembly 114 extends under a bottom portion of the out-swinging operator door panel 302 and includes an interior sill portion 202, an exterior sill portion 204, and a drop-down chamber 206 therebetween. In this example, but as may vary, the interior sill portion 202, the exterior sill portion 204, and the drop-down chamber 206 are supported by a mutual base plate 208 having a substantially straight cross-section portion 210 and an L-shaped cross-section portion 212. In some examples, the base plate 208 may slant downwardly along a portion thereof, such as from the interior sill portion 202 or the drop-down chamber 206 to the exterior sill portion 204, thereby urging any drop-water water or air toward an exterior 118 of a building 102 (FIG. 1).

As shown, the interior sill portion 202 is disposable adjacent an interior 116 of the building 102 (FIG. 1), and may include a longitudinally extending condensation channel 214 open to the building interior 116.

Opposite the interior sill portion 202, the exterior sill portion 204 is disposable adjacent an exterior 118 of the building 102 (FIG. 1) and is configured to allow the out-swinging operator door panel 302 to move between an open and closed (shown) position. In this example, the exterior sill portion 204 includes a drain chamber 218 and a reservoir chamber 220. The drain chamber 218 is positioned below the out-swinging operator door panel 302 and extends between the two vertically extending side jambs 306 (FIG. 3) or a portion thereof. The reservoir chamber 220 is positioned below and to the exterior of the drain chamber 218 and extends also extends between the two vertically extending side jambs 306 (FIG. 3) or a portion thereof.

Between the interior sill portion 202 and the exterior sill portion 204 lies the drop-down chamber 206. The drop-down chamber 206 is positioned at least partially in a weather-strip plane for catching any water (such as wind-blown rain 410 water) that leaks past a longitudinally extending covered weather-strip 224 contacting an underside surface of the out-swinging operator door panel 302. This drop-down chamber 206 is partially defined by the covered weather-strip 224 and an exposed weather-strip 222, both of which may be disposed to come in contact with portions of the out-swinging operator door panel 302. For instance, the exposed weather-strip 222 may be disposed adjacent an interior face of the out-swinging operator door panel 302, such that the strip 222 is flexed by the out-swinging operator door panel 302 when the door is moved to the closed position (shown). The covered weather-strip 224 may be disposed in a close fitting and rubbing relationship with an underside surface of the out-swinging operator door panel 302, such that the strip presses up against the underside surface of the door substantially across its entire length when closed.

The sealing provided by the covered weather-strip 224 aims to keep as much air and water flow as reasonably possible from entering the drop-down chamber 206, such as when the threshold pressure is less than that of the exterior 118 or when wind pressure forces water between the underside of the door and the covered weather-strip 224. Despite the covered weather-strips' 224 efforts, water and air may pass between the strip 224 and the underside surface of the out-swinging operator door panel 302 into the drop-down chamber 206. The exposed weather-strip 222, in conjunction with the interior face of the out-swinging operator door panel 302, prevent this drop-down water and air from penetrating toward the interior 116 of the building 102 (FIG. 1), such as into or past the condensation channel 214. Rather, the drop-down water and air is guided into and through the drain chamber 218 via one or more gutter channels 226 disposed in an inner upwardly extending wall 228 separating the drop-down chamber 206 from the drain chamber 218. The aforementioned weather-strips 222, 224 may comprise any high resiliency material, such as a foam plastic.

The drain chamber 218 is definable by the inner upwardly extending wall 228, an opposite middle upwardly extending wall 230, and one or more insert seals 232 (see also FIG. 2). At least one of the one or more insert seals 232 disposed in the drain chamber 218 may acts as a blocking seal to separate such drain chamber 218 into a water and air inlet chamber 280 and an air outlet chamber 282. In one example, the drain chamber 218 comprises a hollow, substantially rectangular-shaped structure which extends longitudinally the entire length of the threshold assembly 114. Drop-down water and air entering the drain chamber 218 via the one or more gutter channels 226 may be urged toward and into the reservoir chamber 220 via a downwardly slanted base plate 208 portion and one or more gutter channels 238 disposed in the middle upwardly extending wall 230.

The reservoir chamber 220 separates the air and water flowing from the drain chamber 218. The water flows into the reservoir chamber 220 and air is allowed to disperse to the interior of the attached building 102 (FIG. 1) via the one or more gutter channels 226, 238 disposed in the inner 228 and middle 230 upwardly extending walls, respectively, in conjunction with one or more air tubes 252 associated with at least one of the gutter channels of the air outlet chamber 282. After traveling though the one or more air tubes 252 to the interior 116 of the building, the air is allowed to disperse in the condensation channel 214. The reservoir chamber 220 is definable by the middle upwardly extending wall 230, an opposite outer upwardly extending wall 234, and one or more insert seals 236 (FIG. 2). In one example, the reservoir chamber 220 is a hollow, substantially rectangular-shaped structure which extends longitudinally along the entire length of the threshold assembly 114. The reservoir chamber 220 is further provided with a water removal means, such as one or more apertures 240 located at a lower portion of the chamber 220. In another example, the water removal means comprises one or more drain tubes 602 (FIG. 6). The reservoir chamber 220 holds the water when the threshold pressure is less than that of the exterior 118 (FIG. 1). As pressure fluctuates, the water in the reservoir chamber 220 is allowed to rise and fall via the water removal means.

As discussed above, the height of reservoir chamber X may dictate the performance level of a threshold assembly 114. The present threshold assemblies 114 comprise a reservoir chamber 220 that is positioned lower and to the exterior of other portions of the assembly. This lower placement of the reservoir chamber 220 allows a deck 150 (FIGS. 1, 2) or other adjacent surface to be disposed level (or substantially level) with a top surface 290 of the reservoir chamber 220. In this way, the effective height H of the present threshold assembly 114 may be minimized (thereby meeting the ADA guidelines for maximum effective threshold height), while still providing the necessary resistance to water and air intrusion (via the necessary reservoir chamber height X). Further, such lower placement of the reservoir chamber 220 may allow for increased water and air intrusion resistance (as interior 116 and exterior 118 pressures fluctuate). The one or more gutter channels 226, 238 allow the reservoir pressure to be spread throughout the drop-down chamber 206 and the drain chamber 218 thereby providing resistant to water and air intrusion.

Covering portions of the drain chamber 218 and the reservoir chamber 220 is a downwardly ramping top cover 250 extending from the inner upwardly extending wall 228 to the middle 230 or the outer 234 upwardly extending wall. In one example, the top cover 250 includes a non-skid surface. Among other things, the threshold assembly 114 may be manufactured from steel, aluminum, wood, plastic, fiberglass, or combinations thereof; and may be extruded, injection molded or fabricated by any suitable process that lends itself to these materials. By using theses materials and fabrication techniques in conjunction with aforementioned threshold design, the present threshold assemblies provide the strength and rigidity needed to ensure support of weights, such as the weight of the in-swinging operator door panel 302 and the weight of a person who traverses over the threshold 114.

FIG. 6 illustrates one example of a drain tube 602 that may be used in conjunction with the present threshold assemblies 114, specifically the reservoir chamber 220, to increase the pressure of such chamber thereby increasing the water and air resistive performance of the assemblies 114 via a collective threshold pressure. By adding one or more drain tubes 602 to the reservoir chamber, a higher water head (WH) may be retained in the reservoir chamber 220, thereby increasing the water and air resistive performance of the threshold assembly 114. Among other things, the drain tubing may comprise thermoplastic materials, such as polyethylene, polypropylene, polyurethane, or polyvinyl-chloride.

Figure 7:
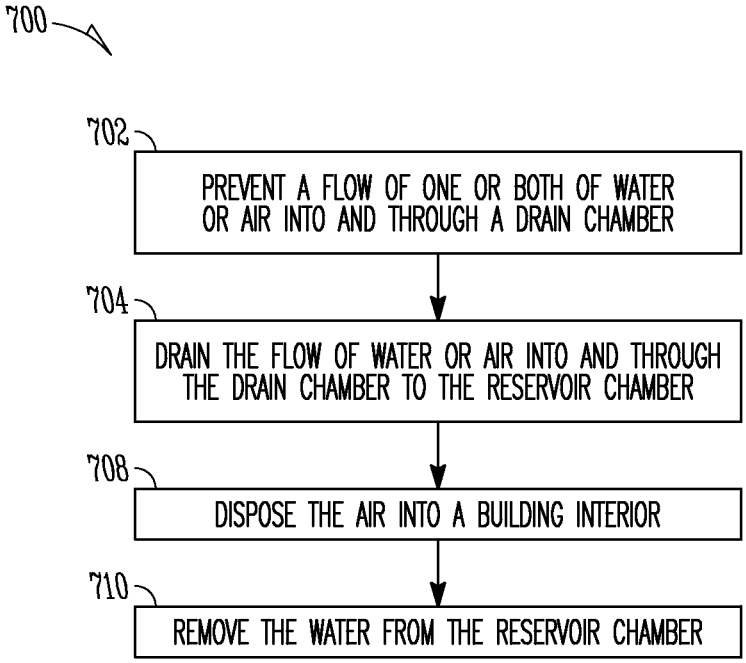
FIG. 7 illustrates a method of draining a flow of water or air out of a door or window threshold assembly, as constructed in accordance with at least one embodiment.

FIG. 7 illustrates a method of draining a flow of water or air out of a door or window threshold assembly. At 702, a flow of one or both of water or air is prevented from entering into and through a drain chamber. The water or air may be prevented from entering a drop-down chamber and subsequently the drain chamber using an exposed or covered weather-strip in conjunction with an appropriately sized reservoir chamber height. At 704, the flow of water or air leaking into the drain chamber is drained to a reservoir chamber positioned lower than, and optionally to the exterior of, the drain chamber. In varying examples, the exposed and covered weather-strips or a downwardly slanted base plate guide the flow of water or air away from a building interior and toward the drain chamber.

At 708, the flow of air reaching the reservoir chamber is allowed back through the drain chamber to a condensation channel where it is dispersed to the interior. The flow of water reaching the reservoir chamber is stored therein until the threshold pressure is equal to or greater than an exterior pressure. At 710, the stored water in the reservoir chamber is removed via one or more drain apertures or drain tubes.

Advantageously, the present threshold assemblies permit the ready evacuation of rain water or condensation, while preventing heavy winds from forcing rain or condensation into such assemblies and subsequently into an interior of a building. In addition to properly dispersing and sealing against water intrusion, the present threshold assemblies may be designed to meet both the ADA threshold size guidelines and any applicable building water intrusion standards via a design in which the effective threshold height is not dependent upon a desired height of the reservoir chamber.

While the present sill assemblies may be used with a variety of units enclosed by, or having, a peripheral frame, a majority of the foregoing description is cast in terms of a sill assembly's use with a door unit for brevity purposes. Such description is not intended, however, to limit the scope of the present subject matter in any way. It is to be understood that the above description is intended to be illustrative, and not restrictive. As one example, the present threshold assemblies may be used with windows and doors of various configurations, such as sliding doors, in-swinging doors, and out-swinging doors. Many other embodiments will be apparent to those of skill in the art upon reviewing the above description. The scope of the present threshold assemblies, apparatuses, and methods should, therefore, be determined with reference to the appended claims, along with the full scope of legal equivalents to which such claims are entitled. In the appended claims, the terms "including" and "in which" are used as the plain-English equivalents of the respective terms "comprising" and "wherein." Also, in the following claims, the terms "including" and "comprising" are open-ended, that is, a system, assembly, article, or process that includes elements in addition to those listed after such a term in a claim are still deemed to fall within the scope of that claim.

The Abstract of the Disclosure is provided to comply with 37 C.F.R. §1.72(b), requiring an abstract that will allow the reader to quickly ascertain the nature of the technical disclosure. It is submitted with the understanding that it will not be used to interpret or limit the scope or meaning of the claims. In addition, in the foregoing Detailed Description, various features may be grouped together to streamline the disclosure. This method of disclosure is not to be interpreted as reflecting an intention that the claimed embodiments require more features than are expressly recited in each claim. Rather, as the following claims reflect, inventive subject matter may lie in less than all features of a single disclosed embodiment. Thus the following claims are hereby incorporated into the Detailed Description, with each claim standing on its own as a separate embodiment.

What is claimed is:

1. A threshold assembly comprising:

an interior sill portion;

an exterior sill portion including a drain chamber and a reservoir chamber, the reservoir chamber at least partially positioned below the drain chamber;

a drop-down chamber positioned between the interior sill portion and the exterior sill portion, the drop-down chamber separated from the drain chamber by a first intervening wall, and the drain chamber separated from the reservoir chamber by a second intervening wall and one or more gutter channels disposed between the drop-down chamber and the drain chamber and between the drain chamber and the reservoir chamber, the one or more gutter channels within and extending through the respective first and second intervening wall wherein a bottom portion of the reservoir chamber includes one or more drain apertures, wherein the total area of the one or more drain apertures is smaller than the total area of the one or more gutter channels within one of the first or second intervening walls.

2. The threshold assembly of claim 1, wherein a reservoir chamber height is equal to or greater than a water head height at a preselected wind load pressure.

3. The threshold assembly of claim 1, wherein a top surface of the reservoir chamber is positioned substantially level with the adjacent exterior surface.

4. The threshold assembly of claim 1, comprising one or more insert seals disposed in one or both of the drain chamber or the reservoir chamber.

5. The threshold assembly of claim 4, wherein at least one of the insert seals comprises a blocking seal disposed to separate the drain chamber into a plurality of water and air receiving chambers.

6. The threshold assembly of claim 1, wherein the reservoir chamber is positioned exterior of an installation opening, and includes a reservoir chamber height equal to or greater than a water head height at a preselected wind load pressure.

7. The threshold assembly of claim 1, wherein the reservoir chamber is configured to receive water entering the threshold assembly between an exterior surface of an operator panel and the threshold assembly.

8. A threshold assembly comprising:

an interior sill portion;

an exterior sill portion including a drain chamber and a reservoir chamber, the reservoir chamber at least partially positioned below the drain chamber; and a drop-down chamber positioned between the interior sill portion and the exterior sill portion, the drop-down chamber separated from the drain chamber by a first intervening wall, and the drain chamber separated from the reservoir chamber by a second intervening wall;

one or more gutter channels disposed between the drop-down chamber and the drain chamber and between the drain chamber and the reservoir chamber, the one or more gutter channels with and extending through the respective first and second intervening walls;

wherein a bottom portion of the reservoir chamber includes one or more drain apertures, wherein a total area of the one or more drain apertures is smaller than a total area of the one or more gutter channels of the first intervening wall, and the total area of the one or more drain apertures is smaller than a total area of the one or more gutter channels of the second intervening wall.

9. The threshold assembly of claim 8, wherein a top surface of the reservoir chamber is positioned substantially level with the adjacent exterior surface.

10. The threshold assembly of claim 8, wherein an effective threshold assembly height is less than or equal to about ¾-inch, as measured from the lower portion of an installation opening.

11. The threshold assembly of claim 8, wherein an upper surface of the threshold assembly is adapted to receive an operator panel, and wherein the reservoir chamber is configured to receive water from the drop-down chamber after water enters the drop-down chamber between an exterior surface of the operator panel and the threshold assembly, and wherein the exterior sill portion of the threshold assembly includes a gasket extending upward from the exterior sill portion and engaged with the operator panel, wherein the interior sill portion of the threshold assembly is positioned entirely below the gasket and the operator panel.

12. The threshold assembly of claim 8, comprising one or more insert seals disposed in one or both of the drain chamber or the reservoir chamber.

13. The window or door assembly of claim 12, wherein at least one of the insert seals comprises a blocking seal disposed to separate the drain chamber into a plurality of water and air receiving chambers.

14. The threshold assembly of claim 8, wherein a reservoir chamber height is equal to or greater than a water head height at a preselected wind load pressure to provide resistance to water and air intrusion while an effective threshold assembly height is less than or equal to ¾-inch.

15. A method of using the threshold assembly of claim 1, comprising:

draining a flow of one or both of water or air from the drop down chamber into and through the drain chamber and through the one or more gutter channels to the reservoir chamber, including draining the flow of water to a portion of the reservoir chamber at a position lower than the drain chamber;

dispersing the air into a building interior; and removing the water from the reservoir chamber, wherein a bottom portion of the reservoir chamber includes one or more drain apertures, and wherein a total area of the one or more drain apertures is smaller than a total area of the one or more gutter channels; and wherein the reservoir chamber height is equal to or greater than a water head height at a preselected wind load pressure to provide resistance to water and air intrusion while the effective threshold assembly height is less than or equal to ¾-inch.

16. The method of claim 15, comprising preventing the flow of one or both of water or air into and through the drain chamber.

17. The method of claim 15, wherein draining the flow of water or air includes using an exposed weather-strip and a covered weather-strip to direct the flow through the drain chamber.

18. The method of claim 15, wherein draining the flow of water or air includes using a base plate sloping downward from the drain chamber to the reservoir chamber.

19. The method of claim 15, wherein removing the water from the reservoir chamber includes releasing the water through the one or more drain apertures when a threshold pressure is equal to or greater than an exterior pressure.

20. The method of claim 15, wherein removing the water from the reservoir chamber includes using one or more drain tubes coupled to a portion of the reservoir chamber.

* * * * *

UNITED STATES PATENT AND TRADEMARK OFFICE

CERTIFICATE OF CORRECTION

PATENT NO. : 8,499,498 B2
APPLICATION NO. : 13/418102
DATED : August 6, 2013
INVENTOR(S) : Thomas J. Heppner It is certified that error appears in the above-identified patent and that said Letters Patent is hereby corrected as shown below:

In the Claims

In column 16, line 16, in Claim 15, delete "chamber;" and insert --chamber, a first intervening wall separating the drop-down chamber from the drain chamber, and a second intervening wall separating the drain chamber from the reservoir chamber, the one or more gutter channels within and extending through the respective first and second intervening walls;--, therefor In column 16, line 22, in Claim 15, delete "channels;" and insert --channels within one of the first or second intervening walls--, therefor Signed and Sealed this
Twentieth Day of May, 2014

Michelle K. Lee

Michelle K. Lee
*Deputy Director of the United States Patent and Trademark Office*